US009290019B2

(12) United States Patent
Nakayama

(10) Patent No.: US 9,290,019 B2
(45) Date of Patent: Mar. 22, 2016

(54) RECORDING PAPER SUPPLY DEVICE, ROLL PAPER PRINTER, AND NEAR-END DETECTION METHOD

(71) Applicant: Seiko Epson Corporation, Tokyo (JP)

(72) Inventor: Hiroyuki Nakayama, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/789,570

(22) Filed: Jul. 1, 2015

(65) Prior Publication Data

US 2016/0009108 A1 Jan. 14, 2016

(30) Foreign Application Priority Data

Jul. 9, 2014 (JP) ..... 2014-141185

(51) Int. Cl.

| | |
|---|---|
| ***B41J 29/38*** | (2006.01) |
| ***B41J 29/393*** | (2006.01) |
| ***B41J 2/01*** | (2006.01) |
| ***B41J 11/00*** | (2006.01) |

(52) U.S. Cl.

CPC ..... *B41J 11/0095* (2013.01)

(58) Field of Classification Search

USPC ..... 347/16, 19, 101

See application file for complete search history.

(56) References Cited

U.S. PATENT DOCUMENTS

| | | | | |
|---|---|---|---|---|
| 9,114,949 | B2 * | 8/2015 | Verdugo | B41J 29/48 |
| 2012/0055272 | A1 * | 3/2012 | Sanada | B41J 15/042 73/865.8 |
| 2012/0257222 | A1 * | 10/2012 | Jiang | B41J 11/0075 358/1.5 |

FOREIGN PATENT DOCUMENTS

| | | |
|---|---|---|
| JP | 2004-161419 A | 6/2004 |
| JP | 2009-102129 A | 5/2009 |

* cited by examiner

*Primary Examiner* — Jason Uhlenhake

(74) *Attorney, Agent, or Firm* — Nutter McClennen & Fish LLP; John J. Penny, Jr.

(57) ABSTRACT

A recording paper supply mechanism 20 of a roll paper printer 1 has a roll paper holder 26 that holds the sides of a paper roll 12 on the transverse axis X at a position above Z1 the roll paper receiver 25. A delivery roller 22 is disposed above Z1 the paper roll 12 on the roll paper receiver 25. A detection unit 24 has a emitter 24A and photodetector 24B position so a detection beam L travels diagonally below the delivery roller 22, and the detection beam L intersects the path A of paper roll 12 movement when rising toward the delivery roller 22. A near-end state can therefore be detected based on output of the detection unit 24 even when the paper roll 12 is raised by force pulling in the delivery direction.

11 Claims, 8 Drawing Sheets

RECORDING PAPER SUPPLY DEVICE, ROLL PAPER PRINTER, AND NEAR-END DETECTION METHOD

BACKGROUND

1. Technical Field

The present disclosure relates to recording paper supply device or to a roll paper printer having a recording paper supply device that pulls and supplies recording paper from a paper roll held in a roll paper compartment, and relates more particularly to a recording paper supply device or a roll paper printer having a detection unit that detects when the amount of recording paper on the paper roll in the roll paper compartment becomes less than a specific amount (a near-end state), and to a method of detecting a near-end state.

2. Related Art

Roll paper printers typically store a roll paper having continuous recording paper wound into a roll in a roll paper compartment, and print while pulling and conveying the recording paper from the paper roll through the conveyance path. Some users of such printers would like advance warning that the paper roll is near the end and the printer will soon be unable to print. Detecting that the recording paper is near the end (detecting a near-end state) before the paper supply is depleted so that a replacement roll can be readied is particularly desirable for users of roll paper printers used to produce receipts because the inability to produce a complete receipt is especially inconvenient. Methods of detecting a near-end state based on the position of the core or the outside surface of the paper roll in the roll paper compartment have therefore been conventionally used to meet this need.

Some roll paper printers use a limit switch or other mechanical sensor in the roll paper compartment to detect a near-end state. Because the outside diameter of the paper roll decreases as the remaining amount of recording paper decreases, this detection method is based on the position of the outside surface of the paper roll moving to the inside circumference side, or the position of the core descending. For example, when the position of the core is not fixed and the paper roll is loaded by simply dropping the paper roll into the roll paper compartment, the paper roll normally rests of its own weight on the bottom of the roll paper compartment, and the position of the core descends as the outside diameter of the paper roll decreases. A near-end state can therefore be detected when the core descends to the position of a detection lever.

However, with a drop-in loading roll paper compartment, the paper roll may become loose inside the roll paper compartment because the core is not affixed, possibly resulting in being unable to deliver the recording paper smoothly and the recording paper becoming skewed. A construction that holds the paper roll between a pair of side panels to hold the paper roll with side pressure applied may be used to enable smoothly delivering roll paper from the roll and prevent skewing. JP-A-2009-102129 discloses a roll paper printer having a roll paper compartment with this type of structure.

The roll paper printer disclosed in JP-A-2009-102129 has a pair of left and right side panels in the roll paper compartment, and a pressure member that is urged to the inside widthwise by a spring is attached to one of the side panels. The paper roll is disposed between this pressure member and the other side panel and held by the urging force of the spring.

In a configuration that holds the paper roll between a side panel and a pressure member as disclosed in JP-A-2009-102129, friction occurs between the side of the paper roll and the side panel or the pressure member. More specifically, the position of the paper roll is determined by the balance of the three forces that work on the paper roll in the roll paper compartment: the upward-pulling force of the recording paper that is pulled from the paper roll, the force of gravity corresponding to the weight of the paper roll, and the friction produced with the side panel or pressure member.

When a large amount of recording paper remains, the paper roll is heavy. Therefore because the force of gravity exceeds the friction, the paper roll will drop and return to the bottom of the roll paper compartment even if the paper roll is lifted off the bottom of the roll paper compartment by the force pulling the paper from the roll. However, when little roll paper remains on the roll, the weight of the paper roll also decreases, and if paper is pulled from the roll and the paper roll is lifted off the bottom of the roll paper compartment, the paper roll may remain in that position by friction and not drop back to the bottom of the compartment. As a result, the paper roll gradually rises in the direction the recording paper is pulled as recording paper is pulled from the paper roll. The outside of the paper roll may therefore end up touching the roller (delivery roller) around which the delivered recording paper travels.

When the paper roll is held between side panels to enable smooth delivery of the roll paper, the paper roll may thus rise in the roll paper compartment as the remaining amount of recording paper decreases. A near-end state can therefore not be detected using a sensor that operates on the assumption the paper roll is resting on the bottom of the roll paper compartment. More specifically, even if the detection lever is located at a height near the bottom of the roll paper compartment based on the assumption that the position of the core will descend as the remaining amount of recording paper decreases, the core will not contact the detection lever because the core rises with the paper roll. Detecting a near-end state may therefore not be possible with the detection lever located as described above.

The roll paper printer described in JP-A-2009-102129 has a structure that prevents the paper roll rising from the bottom of the roll paper compartment. More specifically, in JP-A-2009-102129, the delivery roller is located at the bottom of the roll paper compartment, and a guide roller is located on the opposite side of the roll paper center as the delivery roller. The outside surface of the paper roll is always in contact with the delivery roller and the guide roller, and the parts are located so that the force of the recording paper delivered from the paper roll positioned in contact with the guide roller causing the paper roll to rise acts as the force moving the paper roll to the delivery roller side.

While this configuration can prevent the paper roll from rising in the roll paper compartment, and enables detecting a near-end state with a sensor located as described in the literature, the construction of the roll paper compartment is complicated. More specifically, this configuration uses a plurality of guide rollers and a delivery roller, and these rollers must be disposed in specific relative positions. The freedom of design is therefore low, and reducing the number of parts, device size, and cost is difficult.

SUMMARY

An objective of the present disclosure is to provide a roll paper printer and a recording paper supply device therefor that can detect a near-end state without using a complicated construction that prevents the paper roll from rising, and to a near-end state detection method.

To achieve the foregoing objective, a recording paper supply device according to the invention includes a roll paper storage unit that has a bottom on which a paper roll of recording paper wound into a roll rests, and stores the paper roll; a delivery roller that delivers the recording paper from the paper roll stored in the roll paper storage unit; and a detection unit including an emitter and a photodetector. The delivery roller causes the paper roll to move from a first position resting on the bottom to a second position where the outside surface of the paper roll contacts the delivery roller; and the detection unit detects the light from the emitter to the photodetector with the photodetector when the paper roll is at the second position.

As recording paper is pulled up from the paper roll, the paper roll is pulled in the direction in which the recording paper is delivered, and the paper roll rises from the first position resting on the bottom of the roll paper storage unit toward a second position while being held by the roll paper holder. The recording paper supply device also has a detection unit including an emitter and a photodetector, and a decision unit determines the remaining amount of recording paper on the paper roll is less than a predetermined amount in a near-end state when the photodetector detects the light emitted from the emitter to the photodetector. Thus comprised, when the paper roll is at the first position, the recording paper pulled toward the delivery roller or the paper roll itself reliably intersects (interferes with) the detection beam, and when the paper roll rises to the second position and the outside diameter of the paper roll becomes less than a reference diameter, the photodetector detects the detection beam. As a result, a near-end state can be detected when the photodetector detects the detection beam.

Thus comprised, a near-end state can be reliably detected even when the paper roll is lifted by the force pulling in the delivery direction. As a result, without using a complicated construction that prevents the paper roll from rising, a near-end state can be detected in a device having a drop-in style roll paper storage unit that stores a paper roll so that it can move. The detection unit having an emitter and an opposing photodetector aligned in the direction of the detection beam can be disposed so that the detection beam crosses the path of paper roll movement, and there is no physical contact between the moving paper roll and the parts of the detection unit. The path of light between the emitter and photodetector can therefore be adjusted, and their positions can be determined with a high degree of freedom.

Preferably, the second position in the recording paper supply device of the invention is a position where the outside of the paper roll contacts the delivery roller. When the paper roll stops at a position contacting the delivery roller and the outside diameter decreases at this position, the outside diameter of the paper roll reaching a specific reference diameter can be detected accurately. A near-end state can therefore be accurately detected.

In a recording paper supply device according to another aspect of the invention, the detection unit is disposed so that the light from the emitter to the photodetector is blocked by the paper roll at the first position or the recording paper pulled from the paper roll, and the light is not blocked by the paper roll when the outside diameter of the paper roll at the second position is less than the preset reference diameter.

Thus comprised, while the paper roll moves from the first position to the second position, the recording paper pulled toward the delivery roller or the paper roll itself continues to reliably interrupt the detection beam. The photodetector therefore detects the detection beam when the paper roll has risen to the second position and the outside diameter of the paper roll at this position becomes less than a reference diameter, and otherwise (when the paper roll is on the bottom of the roll paper storage unit or the paper roll is elevated from the bottom but the outside diameter of the paper roll is greater than the reference diameter) the photodetector does not detect the light. That the outside diameter of the paper roll is less than a preset reference diameter, or more specifically that the remaining amount of recording paper on the paper roll is less than a predetermined amount, can be determined based on the photodetector detecting the detection beam. A near-end state can therefore be detected based on the output of the detection unit.

Further preferably, the position of at least one of the emitter and photodetector is adjustable.

Thus comprised, the angle and position of the detection beam can be adjusted. As a result, the outside diameter (reference diameter) of the paper roll when the photodetector changes between detecting and not detecting the detection beam can be changed. How much recording paper remains on the roll when the near-end state is detected can therefore be adjusted.

In a recording paper supply device according to another aspect of the invention, the roll paper holder includes a pair of pressure members disposed on opposite ends of the axis of rotation of the paper roll, and an urging member that urges the pair of pressure members together.

Because the paper roll can be held with pressure on both sides, the paper roll can be prevented from bouncing inside the roll paper storage unit. The recording paper can therefore be delivered smooth and skewing of the recording paper can be reduced. In addition, the paper roll can be held at a position raised from the bottom of the roll paper storage unit by friction between the pressure members and the paper roll. The paper roll can therefore be prevented from bouncing and can be held so the paper roll does not drop of its own weight by a single mechanism.

A roll paper printer according to another aspect of the invention includes the recording paper supply device described above; a conveyance mechanism that conveys the recording paper delivered from the recording paper supply device; a print mechanism that prints on the recording paper at a position along the recording paper conveyance path of the conveyance mechanism; a roll paper loading opening through which the paper roll is loaded into the roll paper storage unit of the recording paper supply device; and an opening/closing unit that carries at least part of the conveyance mechanism and print mechanism, and opens and closes the roll paper loading opening; and one of the emitter and photodetector is disposed to the opening/closing unit.

Thus comprised, the emitter or the photodetector can be pulled to the outside of the roll paper storage unit and exposed by the opening and closing action of the opening/closing unit. Maintenance of the detection unit is therefore simple.

In a roll paper printer according to another aspect of the invention, the opening/closing unit includes an access cover that opens and closes the roll paper loading opening in the front, back or either side of the roll paper storage unit, and a top unit disposed above the roll paper storage unit; the top unit connected the access cover is pulled to the outside of the roll paper loading opening when the access cover pivots at the bottom end thereof and drops to the outside of the roll paper loading opening; either the emitter or the photodetector is disposed to the top unit; and the other of the emitter and the photodetector is disposed to a frame located further inside than the delivery roller from the roll paper loading opening.

Thus comprised, the detection beam of the detection unit crosses the path of paper roll movement at an angle upstream from the delivery roller. A detection unit that can detect a near-end state can therefore be configured. When the emitter or photodetector is attached to a frame member inside the roll paper storage unit, the position where it is attached can be easily adjusted. The angle and position of the detection beam can therefore be changed, and the remaining amount of recording paper at which a near-end state is detected can be adjusted.

In a roll paper printer according to another aspect of the invention, the print mechanism includes a platen mounted on the top unit, and a printhead opposite the platen; and the conveyance mechanism has a roller pair that holds the recording paper, one roller of the roller pair is disposed to the top unit, and the other roller is supported at a position opposite the first roller.

Thus comprised, the printhead, platen, and roller pair can be separated and the conveyance path opened wide by opening the opening/closing unit and pulling the top unit out. Tasks such as loading recording paper to the conveyance path, and removing recording paper from the conveyance path when a paper jam occurs, for example, are therefore simple.

Another aspect of the invention is a near-end state detection method of a recording paper supply device having a roll paper storage unit that stores a paper roll of recording paper wound into a roll, a delivery roller that delivers the recording paper from the paper roll stored in the roll paper storage unit, a detection unit including an emitter and a photodetector, and a decision unit that determines if the remaining amount of recording paper on the paper roll is in a near-end state less than a predetermined amount based on the output of the detection unit, the near-end state detection method including: disposing the paper roll to a first position resting on the bottom of the roll paper storage unit; moving the paper roll to a second position where the outside surface of the delivery roller contacts the paper roll while delivering the recording paper from the paper roll by the delivery roller; and detecting light from the emitter to the photodetector with the photodetector when the paper roll is at the second position.

When the photodetector detects the detection beam, the remaining amount of recording paper on the paper roll is determined to be less than a predetermined amount in a near-end state.

Further preferably, the remaining amount of recording paper is a predetermined amount when the outside diameter of the paper roll is a predetermined reference diameter; the detection unit is disposed so that the detection beam from the emitter to the photodetector is blocked by the paper roll at the first position or the recording paper pulled from the paper roll, and the detection beam is not blocked by the paper roll when the outside diameter of the paper roll at the second position is less than the preset reference diameter; the near-end state is not detected when the photodetector does not detect the detection beam; and the near-end state is detected when the photodetector detects the detection beam.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of an inkjet roll paper printer according to the present invention is described below with reference to the accompanying figures. The roll paper printer in this embodiment of the invention is a receipt printer for producing receipts or other tickets, but can obviously be used for other applications.

General Configuration

Figure 1:
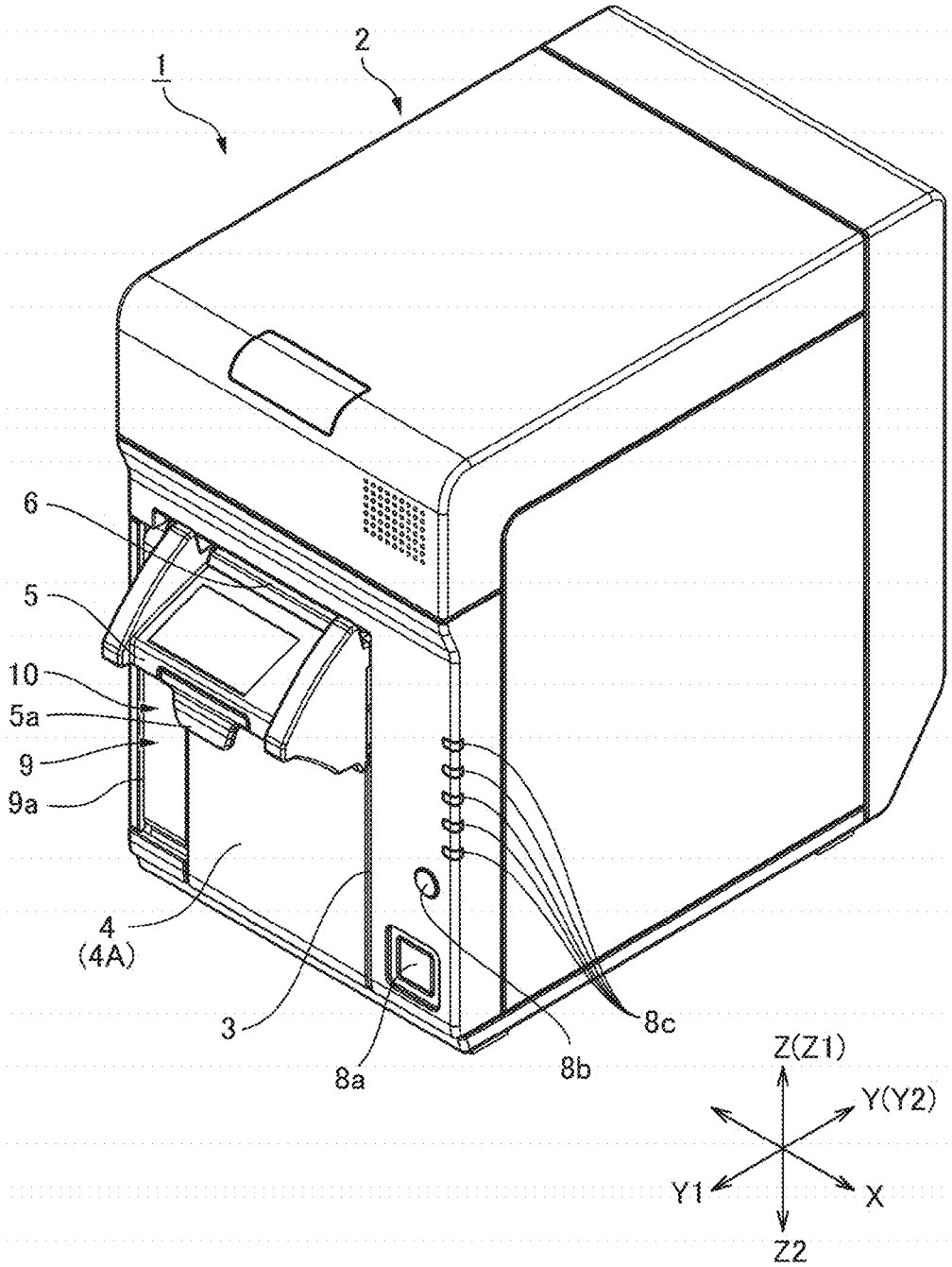
FIG. 1 is an external oblique view of a roll paper printer according to the invention.
Figure 2:
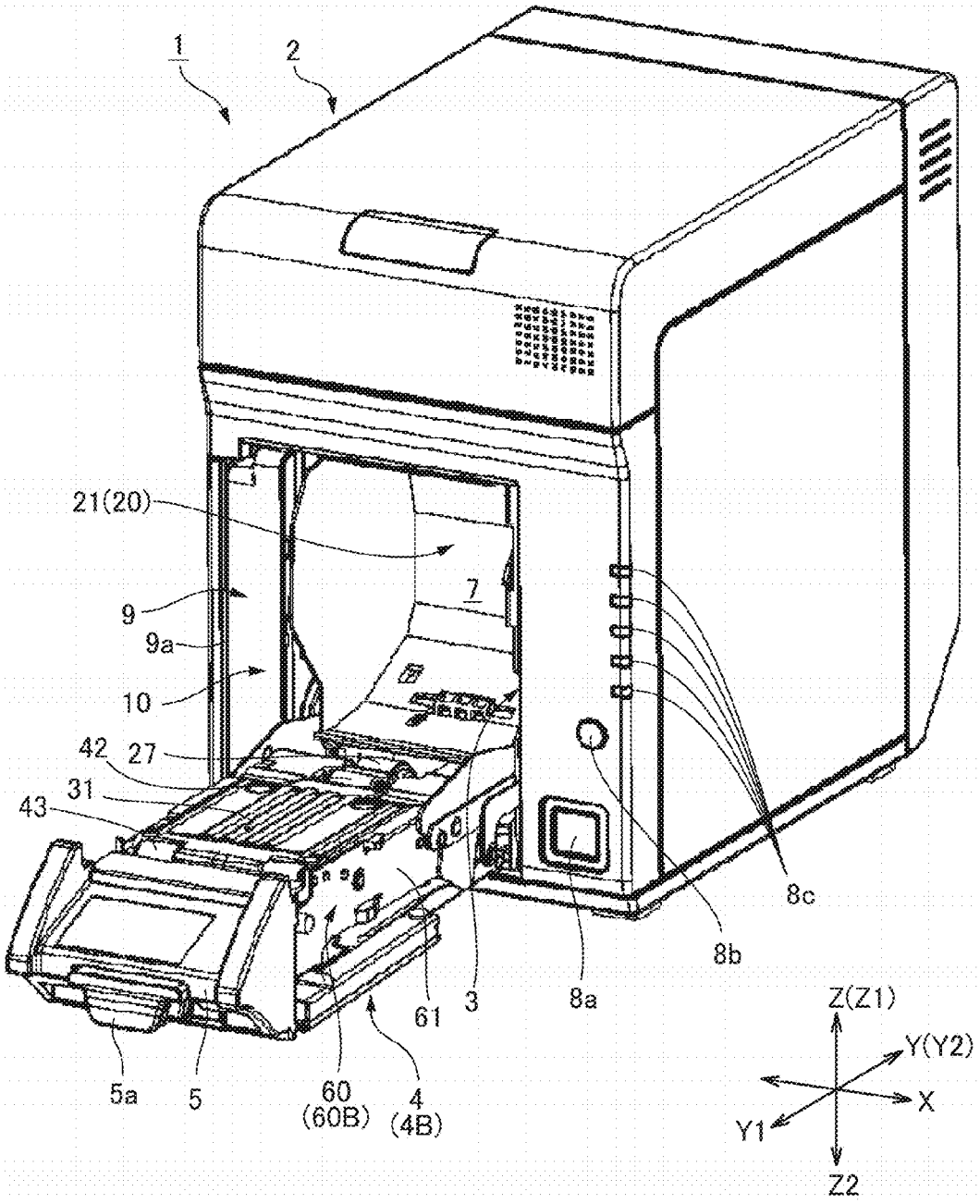
FIG. 2 is an external oblique view showing the roll paper printer with the access cover open.

FIG. 1 is an external oblique view of a roll paper printer according to this embodiment, and FIG. 2 is an external oblique view of the roll paper printer with the access cover open. Below, the transverse axis widthwise to the printer case is the X-axis, the longitudinal axis between the front and back of the printer is the Y-axis, and the vertical axis is the Z-axis. The three axes X, Y, Z are perpendicular to each other. In addition, Y1 denotes the front and Y2 denotes the back on the longitudinal axis Y, and up and down on the vertical axis Z are denoted Z1 and Z2, respectively.

A paper roll of continuous recording paper 11 wound into a roll is loaded inside the roll paper printer 1, which conveys the recording paper 11 from the paper roll 12 for printing. The roll paper printer 1 has a basically rectangular box-like printer case 2. An opening 3 (roll paper loading opening) for loading and removing the paper roll 12 is formed in the front middle part of the printer case 2. An access cover 4 is provided to cover the bottom part of the opening 3, and a paper exit guide 5 is disposed to the top end of the access cover 4. A recording paper exit 6 is formed between the paper exit guide 5 and the top edge of the opening 3 to the printer case 2.

A handle 5*a* that protrudes down from the center of the transverse axis X is disposed to the bottom of the front of the paper exit guide 5. By holding and pulling this handle 5*a* to the front Y1, the handle 5*a* pivots forward, a lock not shown disengages, and the access cover 4 can be opened to the front Y1. When the handle 5*a* is pulled further forward, the access cover 4 pivots at the bottom end of the access cover 4 and swing down to the front Y1 from the closed position 4A shown in FIG. 1 to the open position 4B shown in FIG. 2. Because the paper exit guide 5 is connected to the top of the access cover 4, the paper exit guide 5 moves with the access cover 4 to the front Y1 when the access cover 4 opens. When the access cover 4 opens, the opening 3 is open, and the roll paper compartment 7 formed inside the printer case 2 is exposed.

Disposed to the front of the printer case 2 on the right side of the access cover 4 are a power switch 8*a*, paper feed switch 8*b*, and a plurality of operating state indicators 8*c*. An opening 9*a* to an ink cartridge compartment 9 is formed on the left beside the access cover 4. An ink cartridge 10 is installed to the ink cartridge compartment 9.

Internal Construction

Figure 3:
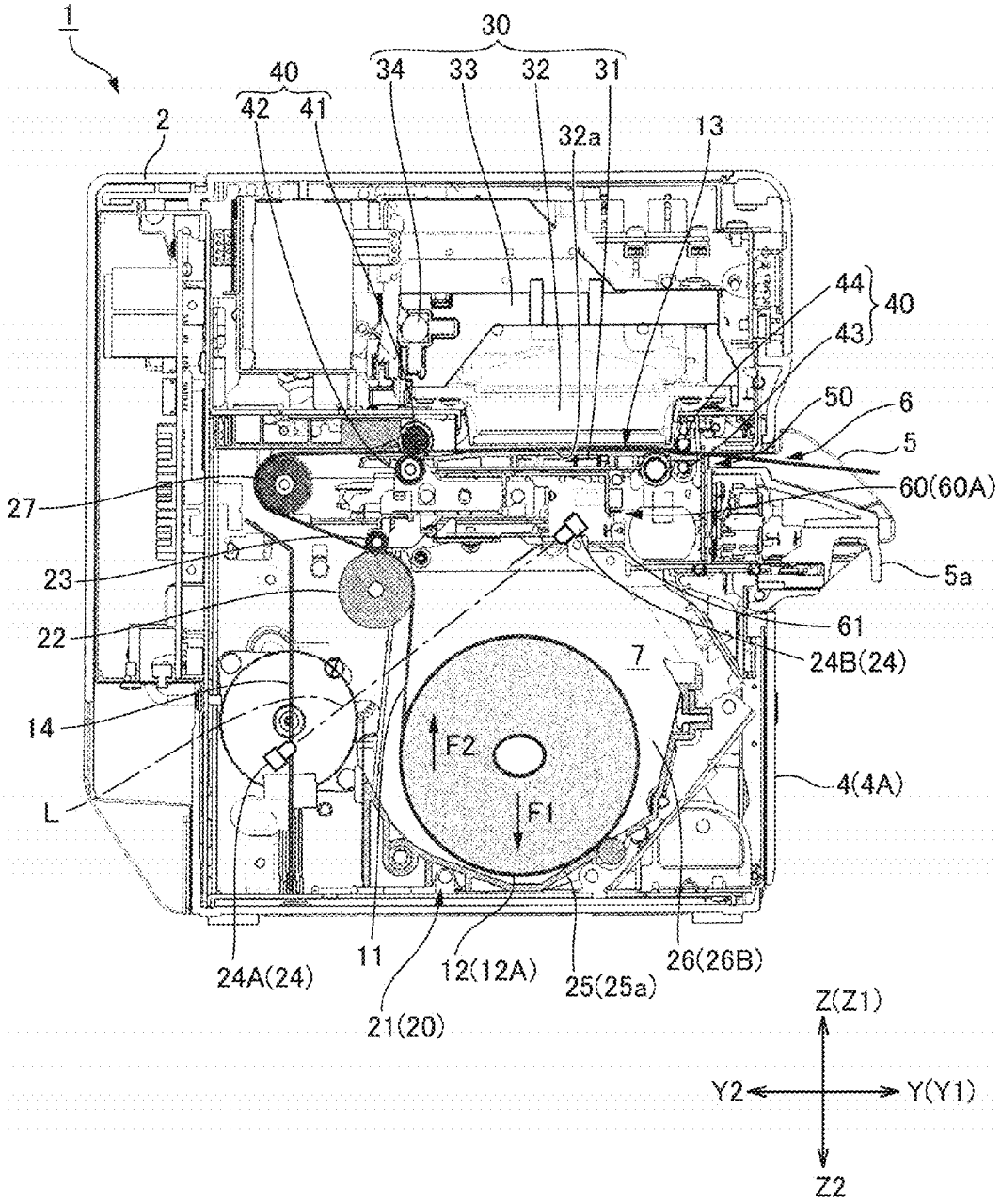
FIG. 3 is a vertical section view of the roll paper printer.

FIG. 3 is a vertical section view showing the internal configuration of the roll paper printer 1 with the access cover 4 closed. As shown in FIG. 2 and FIG. 3, a recording paper supply mechanism 20 (recording paper supply device) that delivers and supplies recording paper 11 from the paper roll 12 is disposed inside the printer case 2 at the bottom near the front Y1. Disposed in the space at the top of the recording paper supply mechanism 20 are a print mechanism 30 including a platen 31 and printhead 32 described below; a conveyance mechanism 40 that conveys the recording paper 11 through a recording paper conveyance path 13 passing the platen 31 and printhead 32; and a recording paper cutting mechanism 50 that cuts the recording paper 11 near the recording paper exit 6.

Recording Paper Supply Mechanism

Figure 4:
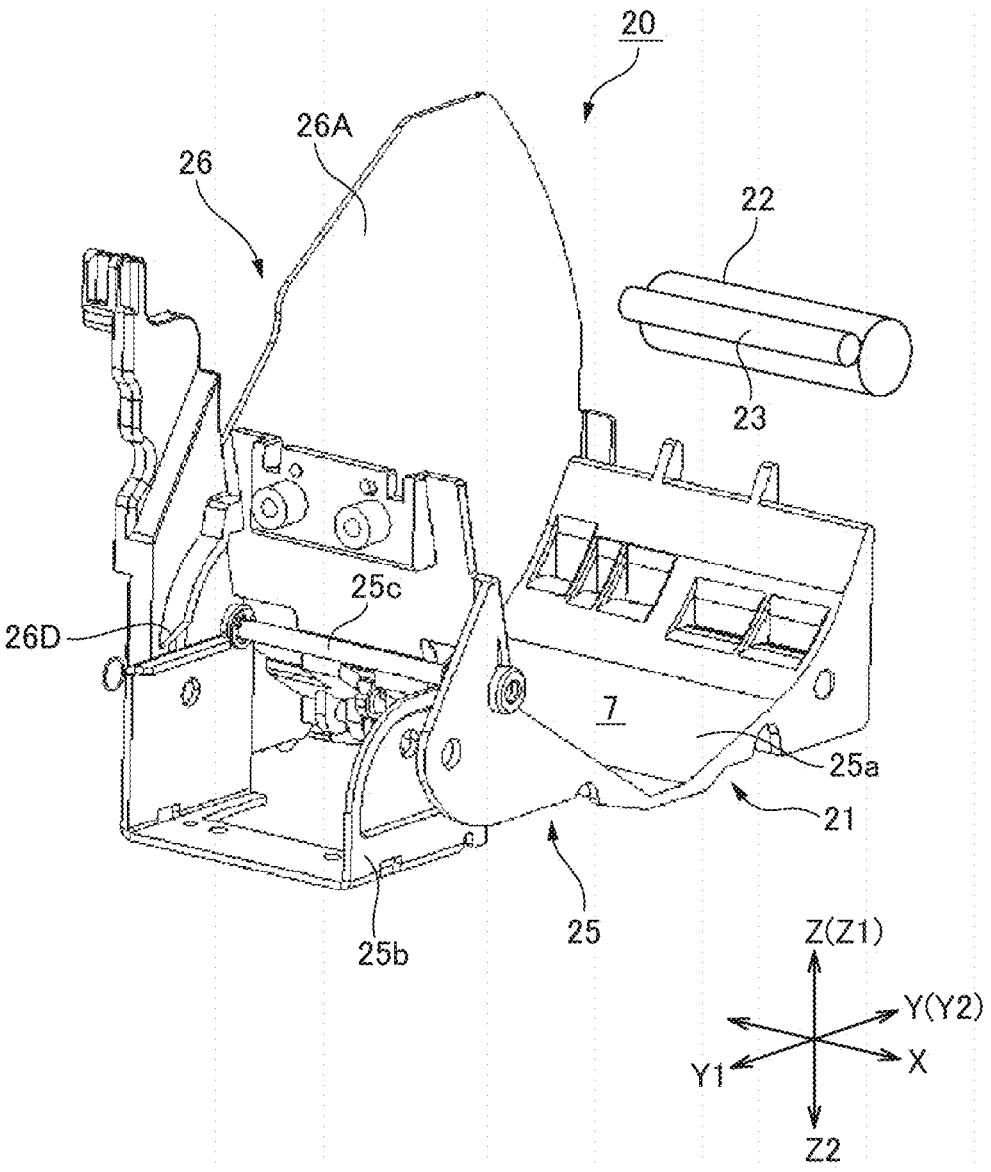
FIG. 4 is an oblique view showing the main parts of the recording paper supply mechanism.

FIG. 4 is an oblique view showing the main parts of the recording paper supply mechanism 20 as seen from the front of the printer. The recording paper supply mechanism 20 has a roll paper storage unit 21, delivery roller 22, pressure roller 23, and a detection unit 24. The detection unit 24 detects when the remaining amount of recording paper 11 on the paper roll 12 reaches a preset level (a near-end state), and is described in detail below.

The roll paper storage unit 21 has a roll paper receiver 25 forming the bottom of the roll paper storage unit 21, and a roll paper holder 26 that holds the paper roll 12 from opposite sides on the transverse axis X at a position above Z1 the roll paper receiver 25. Note that the second side panel 26B (see FIG. 5) of the roll paper holder 26 is not shown in FIG. 4. The roll paper receiver 25 and roll paper holder 26 enclose the roll paper compartment 7.

The roll paper receiver 25 includes a holder 25*a* that is basically curved when seen from the side and opens to the top Z1; a support bracket 25*b* disposed to the front end of the holder 25*a*; and a support rod 25*c* spanning the support bracket 25*b*. The holder 25*a* is supported freely rotatably on the support rod 25*c* extending on the transverse axis X. When a new paper roll 12 is set in the roll paper storage unit 21, the paper roll 12 rests on the holder 25*a* of the roll paper receiver 25 so that it can roll freely on the longitudinal axis Y without holding the core of the paper roll 12.

Figure 5:
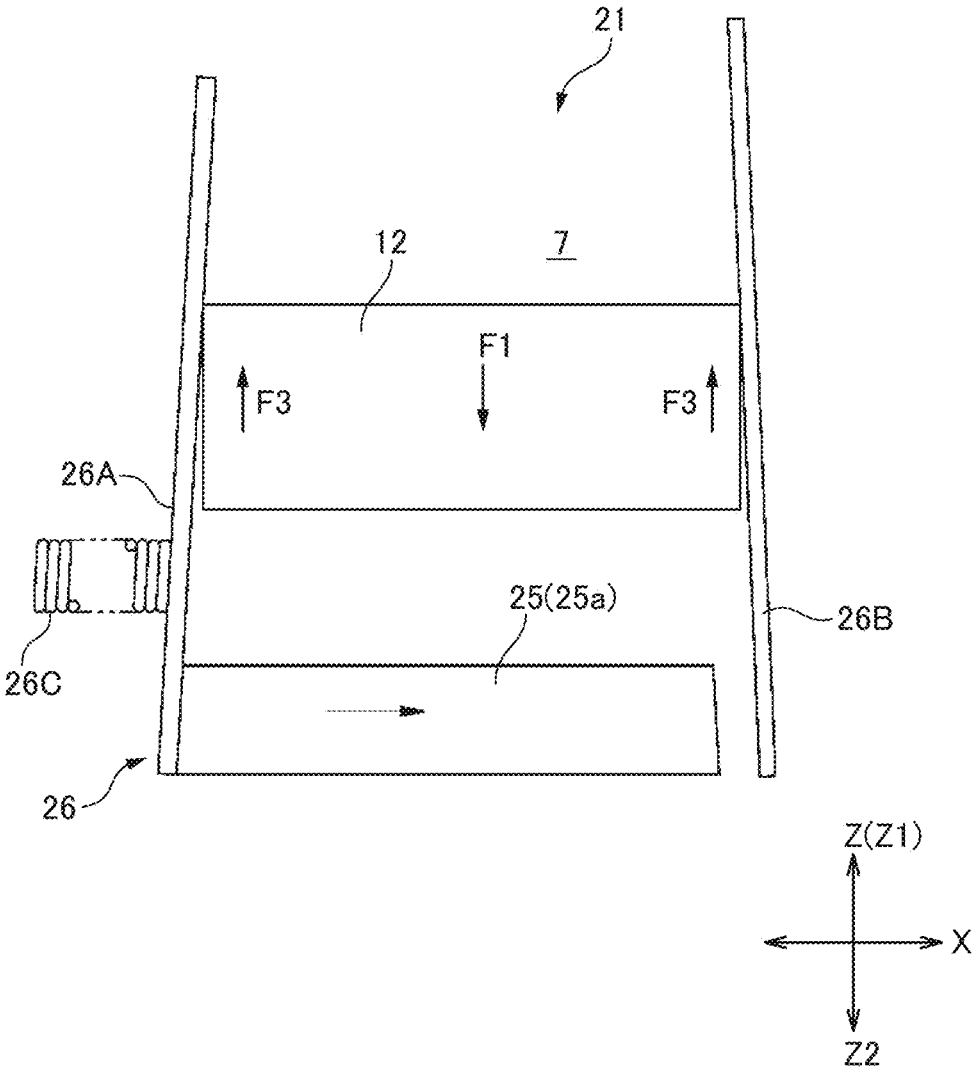
FIG. 5 is a front view schematically showing how a paper roll is stored in the roll paper storage unit.

FIG. 5 is a front view schematically illustrating how a paper roll 12 is held in the roll paper storage unit 21. The roll paper holder 26 includes a first side panel 26A that rises to the top Z1 from one end of the holder 25*a* on the transverse axis X; a second side panel 26B that rises to the top Z1 from the other end of the holder 25*a* on the transverse axis X; a compression spring 26C that urges the first side panel 26A to the second side panel 26B side; and a side pressure release cam 26D. The first side panel 26A and second side panel 26B face each other on the transverse axis X, and incline slightly to the inside on the transverse axis X as they rise to the top Z1. The second side panel 26B is fixed on the frame of the roll paper printer 1. The first side panel 26A and holder 25*a* are supported by the frame of the roll paper printer 1 movably on the transverse axis X. the first side panel 26A and holder 25*a* are moved in unison toward the second side panel 26B side by the urging force of the compression spring 26C. As a result, the paper roll 12 is held between the first side panel 26A and second side panel 26B, and the first side panel 26A and second side panel 26B are pushed against the opposite sides of the paper roll 12.

The roll paper storage unit 21 releases the paper roll 12 as the access cover 4 opens. As shown in FIG. 2, when the access cover 4 drops down and open to the front Y1 (to the outside of the roll paper compartment 7), the holder 25*a* of the roll paper receiver 25 and the roll paper holder 26 pivot on the ends thereof at the opening 3 to the front Y1 at an angle to the opening 3. When the holder 25*a* and first side panel 26A pivot further to the front Y1, they are moved by the side pressure release cam 26D to the outside on the transverse axis X in resistance to the urging force of the compression spring 26C. The side pressure release cam 26D is disposed in the corner where the first side panel 26A and holder 25*a* meet. The side pressure release cam 26D has a taper that contacts the support bracket 25*b* from the outside on the transverse axis X when pivoting to the front Y1. This side pressure release cam 26D causes the gap between the first side panel 26A and second side panel 26B to increase so that the paper roll 12 is released as the access cover 4 opens. As a result, the paper roll 12 can be easily removed or a new paper roll 12 can be easily loaded.

When the access cover 4 closes, the roll paper receiver 25 and roll paper holder 26 pivot in the opposite direction than when opening. Because the side pressure release cam 26D rotates in unison with the access cover 4 at this time, the roll paper receiver 25 and first side panel 26A are moved to the inside on the transverse axis X by the urging force of the compression spring 26C. More specifically, the first side panel 26A approaches the second side panel 26B in conjunction with the closing operation of the access cover 4, and the paper roll 12 is held between the first side panel 26A and second side panel 26B. When the access cover 4 is closed, the recording paper supply mechanism 20 delivers recording paper 11 from the paper roll 12 held with side pressure applied thereto by the first side panel 26A and second side panel 26B.

A delivery roller 22 and pressure roller 23 are disposed in the roll paper storage unit 21 above Z1 the roll paper receiver 25 at the inside back Y2 of the opening 3, and a tension roller 27 is disposed further to the back Y2 near the top Z1. The paper roll 12 is placed on the roll paper receiver 25 with the axis of rotation on the transverse axis X, and the recording paper 11 is pulled up Z1 from the outside of the paper roll 12 at a position at the inside back Y2 from the opening 3. The recording paper 11 pulled from the paper roll 12 is set between the delivery roller 22 and pressure roller 23. After travelling around the delivery roller 22, the recording paper 11 is pulled to the back Y2 and around the tension roller 27. From the tension roller 27, the recording paper 11 is pulled to the front Y1 over the top of the platen 31 located directly above the roll paper storage unit 21, and is pulled from the recording paper exit 6 to the outside front of the printer case 2.

Print Mechanism

The print mechanism 30 includes the platen 31, a printhead 32 disposed above Z1 the platen 31, a head carriage 33 that carries the printhead 32, and a head moving mechanism (not shown in the figure) that moves the head carriage 33 bidirectionally on the transverse axis X along a carriage guide rail 34. The nozzle face 32*a* of the printhead 32 faces the top of the platen 31. The printhead 32 in this embodiment is an inkjet head, and ejects ink supplied from the ink cartridge 10 onto the recording paper 11 to print.

Conveyance Mechanism

The conveyance mechanism 40 includes a paper feed drive roller 41 disposed at the back Y2 of the platen 31; a paper feed driven roller 42 pressed against the paper feed drive roller 41 from below Z2; a discharge drive roller 43 disposed at the front Y1 of the platen 31; and a discharge driven roller 44 pressed from above Z1 to the discharge drive roller 43. These two sets of rollers are turned in synchronization by the drive power from a conveyance motor not shown, and convey the recording paper 11 through the recording paper conveyance path 13 between the platen 31 and printhead 32.

As described above, the recording paper 11 is conveyed from the roll paper compartment 7 of the recording paper supply mechanism 20 past the delivery roller 22 and tension roller 27, and between the paper feed drive roller 41 and paper feed driven roller 42. The tension roller 27 is supported by a tension roller support mechanism that can expand and contract on the longitudinal axis Y, and can move bidirectionally in a line in the direction pushing to the back Y2 and the direction pulled to the front Y1. The tension roller 27 is urged in the direction pushing to the back Y2, and the recording paper 11 is conveyed with specific tension applied thereto by the urging force of the tension roller 27. Variation in the load on the recording paper 11 is absorbed by the bidirectional movement of the tension roller 27, and the conveyance load on the paper feed drive roller 41 is held constant. As a result, the recording paper 11 can be conveyed with good precision.

Recording Paper Cutting Mechanism

The recording paper 11 conveyed past the print position of the recording paper conveyance path 13 and between the discharge drive roller 43 and discharge driven roller 44 is then cut across the width by a recording paper cutting mechanism 50 disposed near the recording paper exit 6. The recording paper cutting mechanism 50 includes a fixed knife disposed above Z1 and a movable knife disposed below the recording paper conveyance path 13. The recording paper slip (not shown in the figure) cut to a particular length may then be issued as a receipt, for example.

Opening/Closing Unit

As shown in FIG. 2 and FIG. 3, the platen 31, paper feed driven roller 42, discharge drive roller 43, the movable knife and drive mechanism of the recording paper cutting mechanism 50, and the tension roller 27 and support mechanism, are disposed to a platen unit frame 61, and move together as a platen unit 60 (top unit). The front Y1 end of the platen unit 60 is connected to the access cover 4 through the paper exit guide 5. The platen unit 60, paper exit guide 5, and access cover 4 open and close together as an opening/closing unit.

When the access cover 4 is closed, the platen unit 60 is in the closed position 60A shown in FIG. 3 with the platen 31 positioned opposite the printhead 32.

When the handle 5*a* of the paper exit guide 5 is pulled forward to open the opening 3 in the front of the printer, the access cover 4 drops to the front Y1 pivoting on a support rod at the bottom end of the access cover 4. As a result, the platen unit 60 is also pulled to the front Y1 to the open position 60B shown in FIG. 2.

The platen unit 60 is supported by a parallel linkage mechanism, and therefore remains horizontal while descending and moving to the front Y1. Because the platen unit 60 is thus pulled to the outside of the opening 3, the roll paper compartment 7 and space thereabove open, and the recording paper conveyance path 13 is open from the roll paper storage unit 21 to the recording paper exit 6. As a result, if a paper jam occurs on the recording paper conveyance path 13, for example, the jammed paper can be easily removed.

Detection Unit

As described above, the detection unit 24 detects when the paper roll 12 loaded in the roll paper storage unit 21 of the recording paper supply mechanism 20 reaches a near-end state, that is, when the remaining amount of recording paper 11 on the paper roll 12 decreases to a preset level. As shown in FIG. 3, a rear frame 14 that is part of the main frame of the roll paper printer 1 is located further inside from the front opening 3 behind (on the back Y2 side of) the roll paper storage unit 21. The detection unit 24 is an optical sensor including a emitter 24A attached to the rear frame 14, and a photodetector 24B attached to the platen unit frame 61.

The direction of the detection beam L from the emitter 24A to the photodetector 24B is at an upward angle from the back inside of the roll paper storage unit 21, and the emitter 24A and photodetector 24B are located so that the detection beam L passes diagonally below the delivery roller 22. As shown in FIG. 3, the delivery roller 22 is located above Z1 the paper roll 12 resting on the roll paper receiver 25. The detection unit 24 is disposed so that the detection beam L passes on an angle between the delivery roller 22 positioned at the top of the recording paper supply mechanism 20, and the paper roll 12 located below the delivery roller 22.

Figure 6:
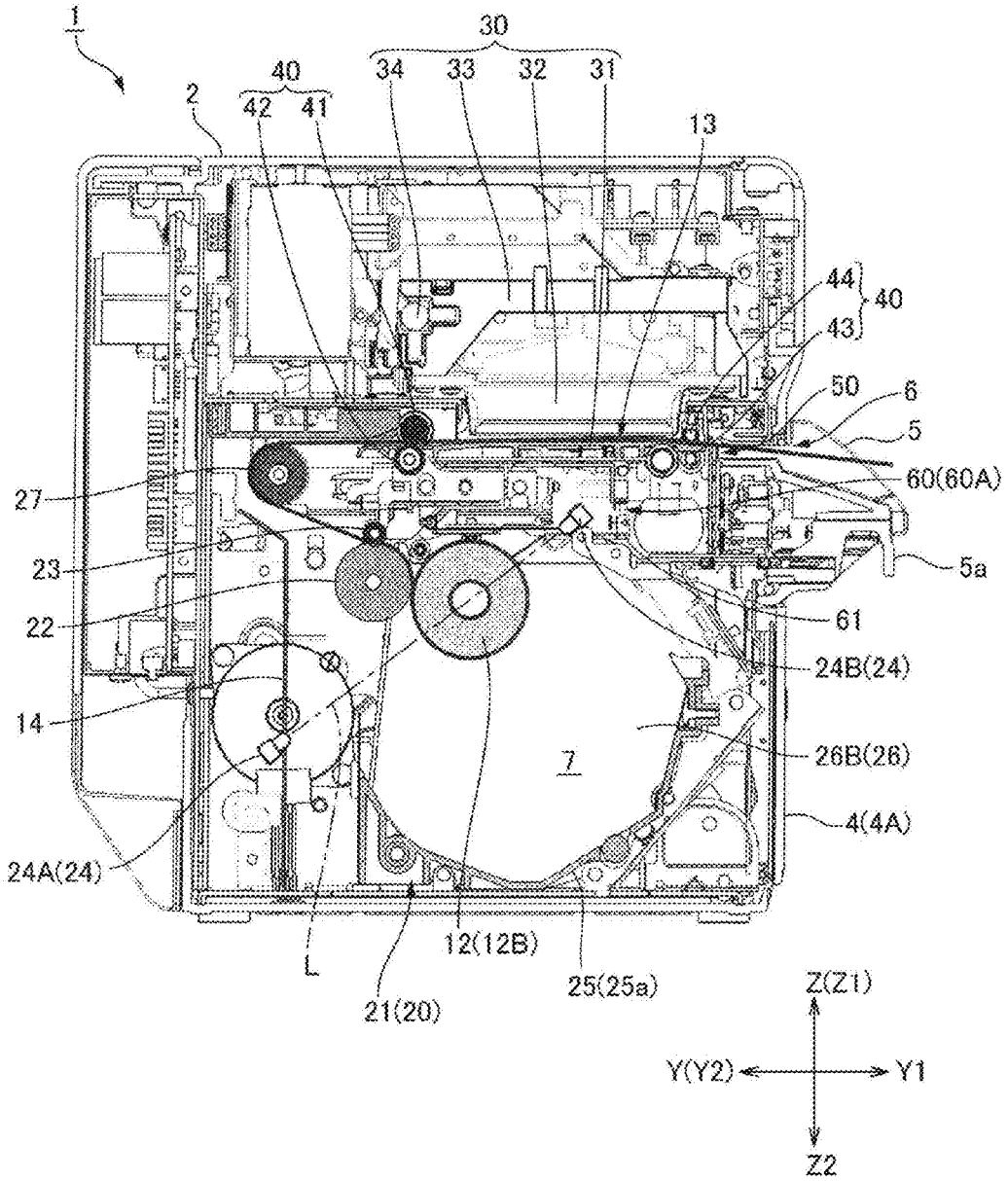
FIG. 6 is a vertical section view of the roll paper printer.
Figure 7:
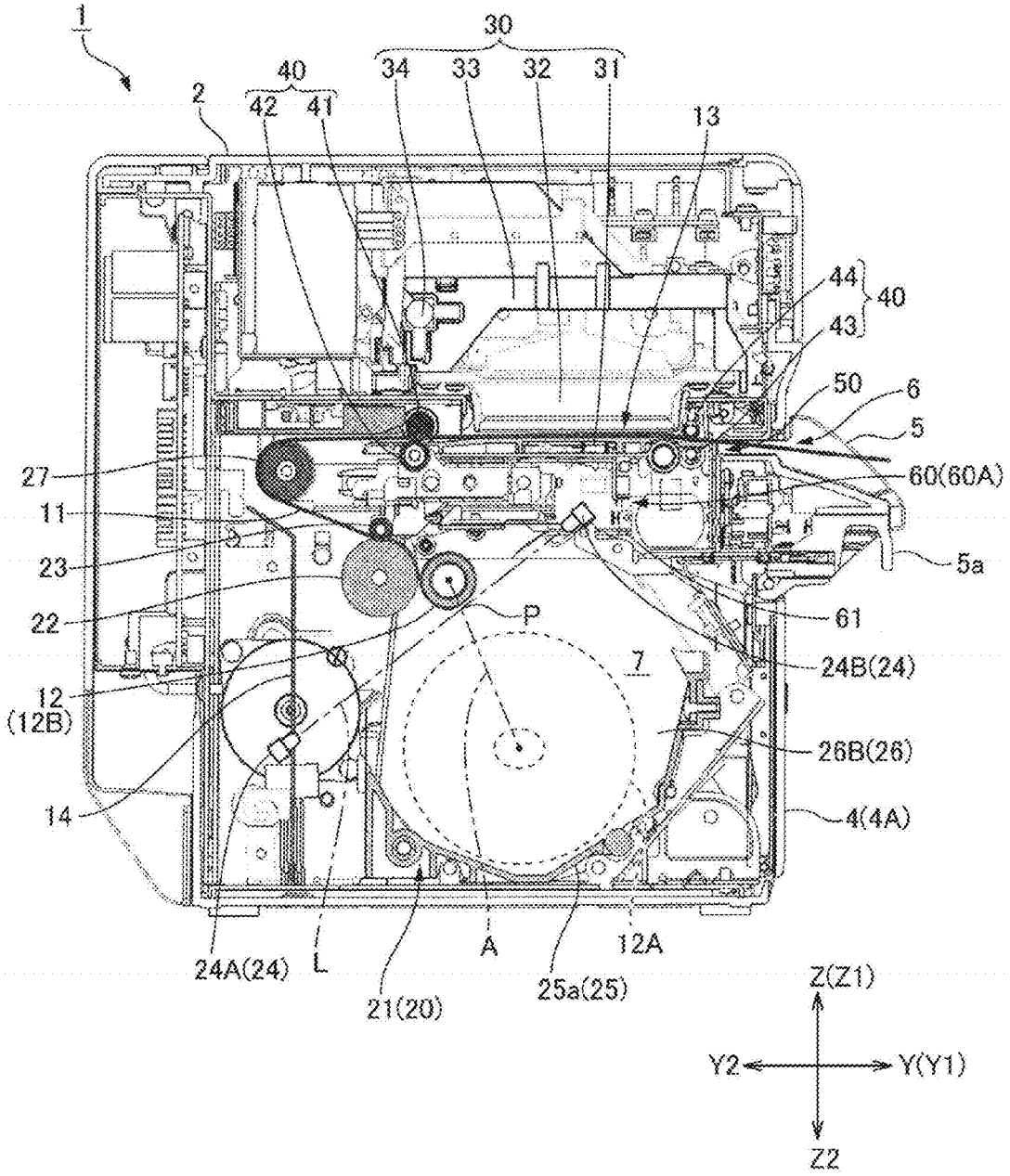
FIG. 7 is a vertical section view of the roll paper printer.

The path of paper roll 12 movement when a new paper roll 12 is placed in the roll paper storage unit 21, the recording paper 11 is conveyed, and the remaining amount of recording paper 11 decreases is described next with reference to FIG. 3, FIG. 6, and FIG. 7. Change in the output of the detection unit 24 at this time is also described. FIG. 6 and FIG. 7 are side section views of the roll paper printer, and illustrate movement of the paper roll 12 to a position in contact with the delivery roller 22.

As already described above, the paper roll 12 is held inside the roll paper storage unit 21 on both sides by the first side panel 26A and second side panel 26B of the roll paper holder 26. As a result, the force of gravity F1 (see FIG. 3, FIG. 5) corresponding to the weight of the paper roll 12, and the pulling force F2 (see FIG. 3) that pulls the paper roll 12 toward the delivery roller 22 side through the recording paper 11 pulled from the paper roll 12, work on the paper roll 12. The friction F3 (see FIG. 5) between the paper roll 12 and the first side panel 26A and second side panel 26B that are pressed against the opposite ends of the paper roll 12 also works on the paper roll 12. The position of the paper roll 12 is determined by the balance between these forces.

When the remaining amount of recording paper 11 on the paper roll 12 is great and the paper roll 12 is heavy, the paper roll 12 drops onto the roll paper receiver 25 even if the paper roll 12 rolls to the front Y1 and rises from the roll paper receiver 25, or the paper roll 12 is pulled up to the delivery roller 22, when the recording paper 11 is pulled from the paper roll 12. This is because the force of gravity F1 is greater than the friction F3 working between the first side panel 26A and second side panel 26B and the paper roll 12, the paper roll 12 drops onto the roll paper receiver 25, and resumes the position resting on the roll paper receiver 25. Note that the position of the paper roll 12 when resting on the roll paper receiver 25 is referred to below as the first position 12A of the paper roll 12.

As described above, the roll paper receiver 25 curves down Z2, and the first position 12A is where the paper roll 12 rests on the bottom Z2 of the roll paper receiver 25. When the paper roll 12 is in the first position 12A, the detection beam L of the detection unit 24 reliably crosses and is blocked by the recording paper 11 extending between the paper roll 12 and delivery roller 22. The detection unit 24 therefore outputs a Not Detected state indicating the photodetector 24B does not detect the detection beam L.

When the remaining amount of recording paper 11 on the paper roll 12 decreases to a certain level, the paper roll 12 becomes lighter and the force of friction F3 exceeds the force of gravity F1. As a result, the paper roll 12 gradually rises to the top Z1 by the pulling force F2 pulling the recording paper 11 to the delivery roller 22 side. As shown in FIG. 6, the paper roll 12 rises until the outside surface of the paper roll 12 contacts the outside surface of the delivery roller 22. In this example, the position where the outsides of the delivery roller 22 and paper roll 12 touch is referred to as the second position 12B of the paper roll 12.

If the outside diameter of the paper roll 12 is a certain size as shown in FIG. 6, the detection beam L will be blocked by the paper roll 12 even if the paper roll 12 rises to the second position 12B. More specifically, when the amount of recording paper 11 remaining on the paper roll 12 is enough that the outside diameter of the paper roll 12 intersects the detection beam L when the paper roll 12 is touching the delivery roller 22, the detection unit 24 outputs the Not Detected state indicating the photodetector 24B does not detect the detection beam L.

After the outside surfaces of the delivery roller 22 and paper roll 12 touch and conveyance of the recording paper 11 continues, the outside diameter of the paper roll 12 continues to decrease gradually while the axis of rotation of the paper roll 12 approaches the delivery roller 22. When the outside diameter of the paper roll 12 decreases to a size (reference diameter) corresponding to a previously set remaining amount of recording paper 11, the detection beam L is no longer blocked by the paper roll 12 as shown in FIG. 7. The detection unit 24 therefore changes to a Detected output state indicating the photodetector 24B detects the detection beam L.

The output state of the detection unit 24 changing from Not Detected to Detected means that the outside diameter of the paper roll 12 reached the preset reference diameter at that time. It can therefore be determined based on the output of the detection unit 24 changing to Detected that the remaining amount of recording paper 11 on the paper roll 12 reached a previously set length (the length corresponding to the reference diameter), that is, reached the near-end state.

Control System

Figure 8:
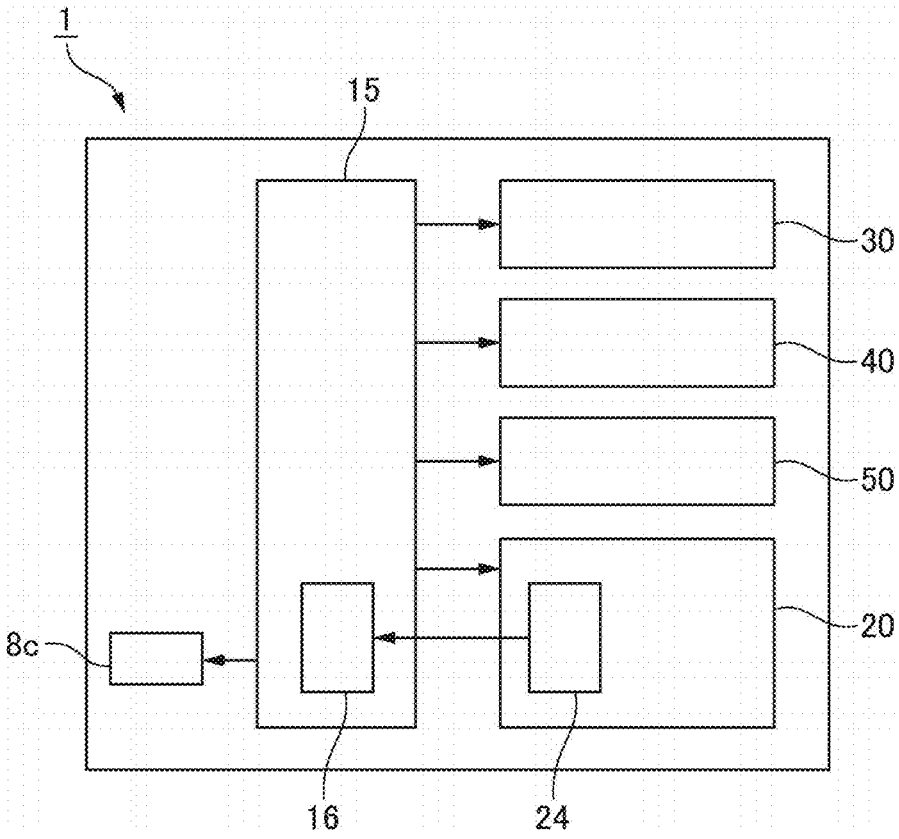
FIG. 8 is a function block diagram showing the control system of the roll paper printer.

FIG. 8 is a block diagram of the control system of the roll paper printer 1. The roll paper printer 1 has a control unit 15 to which the output of the detection unit 24 is input. The control unit 15 receives print data, for example, from an external device, and controls driving the print mechanism 30, conveyance mechanism 40, and recording paper cutting mechanism 50 to convey, print, and cut the recording paper 11 to produce a receipt based on the received print data and other data. Output from sensors disposed to parts of the roll paper printer 1 are input to the control unit 15, and the output of the detection unit 24 is also input to the control unit 15. The control unit 15 has a decision unit 16 that determines if the near-end state was reached based on input from the detection unit 24. As described above, the decision unit 16 determines a near-end state was reached based on the output of the detection unit 24 going to Detected. The control unit 15 also functions as the control unit of the recording paper supply mechanism 20, controls driving the delivery roller 22, and controls delivering recording paper 11 from the recording paper supply mechanism 20. When the decision unit 16 detects a near-end state, the control unit 15 controls reporting the near-end state by an appropriate means. For example, the control unit 15 may cause one or more of the plural operating state indicators 8*c* to light in a predetermined manner. Alternatively, the control unit 15 may report the near-end state to the host device that supplies print data, for example, to the roll paper printer 1.

Determining where the Detection Beam Passes

The configuration of the detection unit 24 enabling detecting a near-end state as described above, and more particularly determining where the detection beam L passes based on the positions of the emitter 24A and photodetector 24B, are described next. As described above, as described above, as the remaining amount of recording paper 11 decreases in the roll paper printer 1 according to this embodiment, the paper roll 12 moves from the first position 12A resting on the roll paper receiver 25 to the second position 12B where the outside surface touches the delivery roller 22, and the outside diameter thereof then continues to get smaller. The path A of paper roll 12 movement at this time is the path connecting the first position 12A of the paper roll 12 to the paper roll 12 touching the delivery roller 22. The roll paper holder 26 guides movement along this path A while holding the paper roll 12 elevated from the roll paper receiver 25 by the friction F3 with the paper roll 12.

The detection unit 24 is set so that the detection beam L from the emitter 24A to the photodetector 24B passes between the paper roll 12 at the first position 12A and the delivery roller 22, that is, so that the detection beam L intersects (interferes with) the recording paper 11 pulled from the paper roll 12 in the first position 12A. Alternatively, the detection unit 24 may be set so that the detection beam L is blocked by the paper roll 12 itself when the paper roll 12 of maximum diameter is at the first position 12A. Further alternatively, the detection unit 24 may be set so that there is no interference between the paper roll 12 and the detection beam L when the outside diameter of the paper roll 12 at the second position 12B is less than a preset outside diameter.

When the position where the detection beam L passes is thus set, a state in which the detection beam L is reliably blocked by the recording paper 11 or the paper roll 12 can be maintained from when supplying recording paper 11 from the paper roll 12 on the roll paper receiver 25 starts until the paper roll 12 contacts the surface of the delivery roller 22. The detection beam L can also be reliably blocked while the outside diameter of the paper roll 12 is greater than the reference diameter after the paper roll 12 contacts the outside of the delivery roller 22. When the outside diameter of the paper roll 12 becomes smaller than the reference diameter, the outside of the paper roll 12 recedes to the delivery roller 22 side from the point of intersection P (see FIG. 7) between the path A and the detection beam L. As a result, the paper roll 12 does not block the detection beam L.

The remaining amount of recording paper 11 when a near-end state is detected corresponds to the point of intersection P where the detection beam L and path A intersect. The closer the point of intersection P is to the delivery roller 22, the smaller the outside diameter (reference diameter) of the paper roll 12 at which the detection unit 24 output changes from Not Detected to Detected. More specifically, less recording paper 11 remains when the near-end state is detected. Conversely, the farther the point of intersection P is from the delivery roller 22, the larger the outside diameter (reference diameter) of the paper roll 12 at which the detection unit 24 output changes from Not Detected to Detected. More specifically, more recording paper 11 remains when the near-end state is detected.

The point of intersection P between the path A and detection beam L can be changed by adjusting the angle of the detection beam L or the position of the detection beam L (the position on the longitudinal axis Y and the vertical axis Z). The positions of the emitter 24A and photodetector 24B are adjusted to change the position of the detection beam L. The position of the emitter 24A or the photodetector 24B can be changed to adjust the angle of the detection beam L. In this embodiment, the height where the emitter 24A is attached to the rear frame 14 can be adjusted on the vertical axis Z. Therefore, by adjusting the height of the emitter 24A, the angle of the detection beam L can be adjusted and the amount of recording paper 11 remaining when a near-end state is detected can be adjusted. The photodetector 24B has a collector lens, and can detect the detection beam L if the change in the orientation of the detection beam L is within the collection range of the collector lens.

Operating Effect

As described above, this embodiment of the invention has a detection unit 24 including an emitter 24A and photodetector 24B disposed so that the detection beam L passes diagonally below the delivery roller 22, the detection beam L emitted from the emitter 24A to the photodetector 24B may be blocked by the paper roll 12 at the first position 12A or by the recording paper 11 pulled from the paper roll 12, and there is no interference between the paper roll 12 and the detection beam L when the outside diameter of the paper roll 12 at the second position 12B is less than a preset reference diameter. That the paper roll 12 rose to the second position 12B and the outside diameter of the paper roll 12 at that position decreased to less than the reference diameter can therefore be determined based on output from the detection unit 24. More specifically, a near-end state can be detected based on output from the detection unit 24 even if the paper roll 12 is lifted up by the force pulling in the delivery direction of the recording paper 11. As a result, without using a complicated construction that prevents the paper roll from rising, a near-end state can be detected in a device having a drop-in style roll paper storage unit 21 that stores a paper roll 12 so that the paper roll 12 can move without holding the core.

Furthermore, the outside diameter of the paper roll 12 reaching a specific reference diameter can also be detected accurately because the paper roll 12 stops in a position with the outside surface touching the delivery roller 22 and the outside diameter of the paper roll 12 continues decreasing at this position. A near-end state can therefore be accurately detected.

The detection unit 24 having a emitter 24A and photodetector 24B also enables moving the positions of the emitter 24A and photodetector 24B in the direction of the detection beam L without moving the position where the detection beam L passes. The degree of freedom placing the emitter 24A and photodetector 24B is therefore great. Note that in this embodiment the outside diameter of the paper roll 12 decreases at the second position 12B in contact with the delivery roller 22, but configurations in which upward movement of the paper roll 12 is limited by contact with another member and the outside diameter of the paper roll 12 decreases at this position are also conceivable.

In this embodiment of the invention the position where the emitter 24A is attached to the rear frame 14 inside the roll paper storage unit 21 can be adjusted, and the angle of the detection beam L can be adjusted by adjusting the position of the emitter 24A. The outside diameter (reference diameter) of the paper roll 12 at which the photodetector 24B changes between detecting and not detecting the detection beam L can therefore be changed. How much recording paper 11 remains when a near-end state is detected can therefore be changed.

In this embodiment of the invention the platen unit 60 located above the roll paper storage unit 21, the access cover 4, and the paper exit guide 5 together embody an opening/closing unit that opens and closes together with the photodetector 24B mounted on the platen unit 60. Because the platen unit 60 is pulled outside from the opening 3 by the opening operation, the photodetector 24B also moves outside at the same time. The photodetector 24B is therefore exposed and maintenance is easy.

Variations

Conversely to the configuration described above, the emitter 24A may be mounted on the platen unit 60 and the photodetector 24B attached to the rear frame 14. The position where the part (emitter 24A or photodetector 24B) affixed to the platen unit 60 is attached may also be adjusted. Further alternatively, the members that carry the emitter 24A and photodetector 24B are not limited to the platen unit 60 and rear frame 14, and may be members disposed closer to or farther from the delivery roller 22 than the platen unit 60 and rear frame 14.

The foregoing embodiment has the opening 3 through which paper roll 12 is loaded disposed to the front of the roll paper printer 1, and the opening/closing unit (access cover 4, paper exit guide 5, platen unit 60) configured to open when pulled to the front Y1, but the opening 3 may be formed in a side or the back of the roll paper printer 1, and the opening/closing unit configured to open and close to the side or the back Y2.

The foregoing embodiment applies the invention to a printer with an inkjet head, but the invention can be applied to any printer that holds a paper roll and prints on roll paper, regardless of the printing method. For example, the invention can also be applied to thermal printers.

This embodiment applies the invention to a recording paper supply device built into a printer, but the invention can also be applied to a recording paper supply device constructed separately from the printer.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A recording paper supply device comprising:

a roll paper storage unit that has a bottom on which a paper roll of recording paper wound into a roll rests, and stores the paper roll;

a delivery roller that delivers the recording paper from the paper roll stored in the roll paper storage unit; and a detection unit including an emitter and a photodetector;

wherein the delivery roller is configured to move the paper roll from a first position resting on the bottom to a second position where the outside surface of the paper roll contacts the delivery roller; and the detection unit is configured to detect the light from the emitter to the photodetector with the photodetector when the paper roll is at the second position.

2. The recording paper supply device described in claim 1, further comprising:

a decision unit configured to determine the remaining amount of recording paper on the paper roll is in a near-end state less than a predetermined amount based on the output of the detection unit; and a roll paper holder that holds the paper roll moved from the first position to the second position elevated from the bottom;

wherein the decision unit determines the near-end state when the photodetector detects the light.

3. The recording paper supply device described in claim 1, wherein:

the detection unit is disposed so that the light from the emitter to the photodetector is blocked by the paper roll at the first position or the recording paper pulled from the paper roll, and the light is not blocked by the paper roll when the outside diameter of the paper roll at the second position is less than the preset reference diameter.

4. The recording paper supply device described in claim 1, wherein:

the position of at least one of the emitter and photodetector is adjustable.

5. The recording paper supply device described in claim 1, wherein:

the roll paper holder includes a pair of pressure members disposed on opposite ends of the axis of rotation of the paper roll, and an urging member that urges the pair of pressure members together.

6. A roll paper printer comprising:

the recording paper supply device described in claim 1;

a conveyance mechanism that conveys the recording paper delivered from the recording paper supply device;

a print mechanism that prints on the recording paper at a position along the recording paper conveyance path of the conveyance mechanism;

a roll paper loading opening through which the paper roll is loaded into the roll paper storage unit of the recording paper supply device; and an opening/closing unit that carries at least part of the conveyance mechanism and print mechanism, and opens and closes the roll paper loading opening; and one of the emitter and photodetector is disposed to the opening/closing unit.

7. The roll paper printer described in claim 6, wherein:

the opening/closing unit includes an access cover that opens and closes the roll paper loading opening in the front, back or either side of the roll paper storage unit, and a top unit disposed above the roll paper storage unit;

the top unit connected the access cover is pulled to the outside of the roll paper loading opening when the access cover pivots at the bottom end thereof and drops to the outside of the roll paper loading opening;

either the emitter or the photodetector is disposed to the top unit; and the other of the emitter and the photodetector is disposed to a frame located further inside than the delivery roller from the roll paper loading opening.

8. The roll paper printer described in claim 6, wherein:

the print mechanism includes a platen mounted on the top unit, and a printhead opposite the platen;

and the conveyance mechanism has a roller pair that holds the recording paper, one roller of the roller pair is disposed to the top unit, and the other roller is supported at a position opposite the first roller.

9. A near-end state detection method of a recording paper supply device having a roll paper storage unit that stores a paper roll of recording paper wound into a roll without fixing the position of the core of the paper roll, a delivery roller that delivers the recording paper from the paper roll stored in the roll paper storage unit, a detection unit including an emitter and a photodetector, and a decision unit that determines if the remaining amount of recording paper on the paper roll is in a near-end state less than a predetermined amount based on the output of the detection unit, the near-end state detection method comprising:

disposing the paper roll to a first position resting on the bottom of the roll paper storage unit;

moving the paper roll to a second position where the outside surface of the delivery roller contacts the paper roll while delivering the recording paper from the paper roll by the delivery roller; and detecting light from the emitter to the photodetector with the photodetector when the paper roll is at the second position.

10. The near-end state detection method described in claim 9, further comprising:

determining the remaining amount of recording paper on the paper roll is in a near-end state less than a predetermined amount when the photodetector detects the light.

11. The near-end state detection method described in claim 10, wherein:

the remaining amount of recording paper is a predetermined amount when the outside diameter of the paper roll is a predetermined reference diameter;

the detection unit is disposed so that the detection beam from the emitter to the photodetector is blocked by the paper roll at the first position or the recording paper pulled from the paper roll, and the detection beam is not blocked by the paper roll when the outside diameter of the paper roll at the second position is less than the preset reference diameter;

the near-end state is not detected when the photodetector does not detect the detection beam; and the near-end state is detected when the photodetector detects the detection beam.

* * * * *